73-151 SR
1/1/85 XR 4,491,927

United States Patent [19]

Bachmann et al.

[11] Patent Number: 4,491,927

[45] Date of Patent: Jan. 1, 1985

[54] DEPTH MONITORING SYSTEM

[75] Inventors: Einar H. Bachmann, Wilmette, Ill.; Kristjan Ingvarsson, Gardabae, Iceland

[73] Assignee: The Digger Meter Corporation, Chicago, Ill.

[21] Appl. No.: 327,477

[22] PCT Filed: Apr. 6, 1981

[86] PCT No.: PCT/US81/00440

§ 371 Date: Dec. 4, 1981

§ 102(e) Date: Dec. 4, 1981

[87] PCT Pub. No.: WO81/02904

PCT Pub. Date: Oct. 15, 1981

Related U.S. Application Data

[63] Continuation-in-part of Ser. No. 139,603, Apr. 11, 1980, abandoned.

[51] Int. Cl.[3] ..... E02F 5/04

[52] U.S. Cl. ..... 364/561; 37/DIG. 1; 73/151; 340/686

[58] Field of Search ..... 364/422, 560–562; 37/80 R, 103, DIG. 1; 340/612, 678, 679, 685, 686, 689; 414/697–700, 705; 33/1 PT, 125 B; 73/151, 151.5

[56] References Cited

U.S. PATENT DOCUMENTS

| | | | |
|---|---|---|---|
| 3,691,363 | 9/1972 | Armistead | 364/422 |
| 4,129,224 | 12/1978 | Teach | 414/700 |
| 4,173,836 | 11/1979 | Paurat | 37/DIG. 1 |
| 4,231,700 | 11/1980 | Studebaker | 414/700 |
| 4,238,828 | 12/1980 | Hay et al. | 364/422 |

*Primary Examiner*—Edward J. Wise
*Attorney, Agent, or Firm*—Bernard L. Kleinke

[57] ABSTRACT

A depth monitoring system includes a pair of inclinometer sensors mounted on the boom and on the dipper stick of a digging machine to measure electrically the angle of inclination of the boom and the dipper stick relative to the horizontal. Employing these two sensors, the position of the bucket connected pivotally to the free end of the dipper stick can be calculated by means of a simple geometric equation in which each trigonometric function is based on a single angle only. Additionally, preset and zero reference capabilities are provided.

10 Claims, 7 Drawing Figures

TO OPERATE
1. PLACE BUCKET ON REFERENCE POINT
ZERO OUT DISPLAY
2. SET DIGGING DEPTH FOR BEEPER.
3. SWITCH TO RUN.
SET
RUN
ZERO
ON
OFF
12.0
10
12
14
16
18
20
22
24
26
28
31
33
35
37
39
41
43
45
47
49
A
B
C
X
Y
Z
$R_A$
$R_B$
$R_C$
$h_0$
$h_1$
$h_2$
$h_3$
h

DEPTH MONITORING SYSTEM

This application is a continuation-in-part of application Ser. No. 139,603, filed Apr. 11, 1980, and now abandoned, entitled "Depth Monitoring System".

DESCRIPTION

1. Technical Field

The present invention relates in general to depth monitoring apparatus, and it more particularly relates to a system adapted to be mounted on a digging machine having a boom, dipper stick and a bucket for measuring the depth of a hole being dug by the machine.

2. Background Art

Many different types and kinds of digging machines are employed for excavating work, such as removing earth to form a foundation for a building. An important part of the excavating work is to know the depth of the excavating device, usually a bucket, so that the depth of the hole to be dug is maintained as close as possible to the desired depth without exceeding it. Usually, this is done by manual measurement with a stake or the like, either by the operator or by an assistant. Such a manual operation is both time-consuming and dangerous, since it exposes the person to the often slippery edges of deep holes.

In an attempt to overcome the problems associated with measuring techniques, different types and kinds of equipment have been employed. For example, reference may be made to the following U.S. Pat. Nos. 3,997,071; 4,028,822; 4,034,490 and 4,129,224. In U.S. Pat. No. 3,997,071, there is disclosed an apparatus for indicating the digging depth for a backhoe. An analog circuit is provided to compute the trigonometric relationship between the boom, dipper stick and the bucket to calculate the depth of the bucket relative to the pivot for the boom. The trigonometric equation involves the addition of three angular relationships between the boom, dipper stick and the bucket. However, by adding electrically the angular relationships and taking the trigonometric functions, such as the sine of such an addition, any errors involved with performing such a measurement electrically, causes a compounding of the error, thereby introducing unwanted inaccuracies in the calculations. Therefore, it would be highly desirable to have a depth measuring system, which is inherently more accurate in its measurement.

Therefore, the principal object of the present invention is to provide a new and improved depth measuring system, which is highly accurate in its calculations.

Another object of the present invention is to provide such a new and improved depth measuring system, which has preset and zero reference capabilities.

DISCLOSURE OF INVENTION

Briefly, the above and further objects are realized in accordance with the present invention by providing a pair of inclinometer sensors mounted on the boom and on the dipper stick of a digging machine to measure electrically the angle of inclination of the boom and the dipper stick relative to the horizontal. Employing these two sensors, the position of the bucket connected pivotally to the free end of the dipper stick can be calculated by means of a simple geometric equation in which each trigonometric function is based on a single angle only. Additionally, preset and zero reference capabilities are provided.

BRIEF DESCRIPTION OF DRAWINGS

The above-mentioned and other objects and features of this invention and the manner of attaining them will become apparent, and the invention itself will be understood by reference to the following description of an embodiment of the invention taken in conjunction with the accompanying drawings, wherein.

BEST MODE FOR CARRYING OUT THE INVENTION

Figures 1, 2:
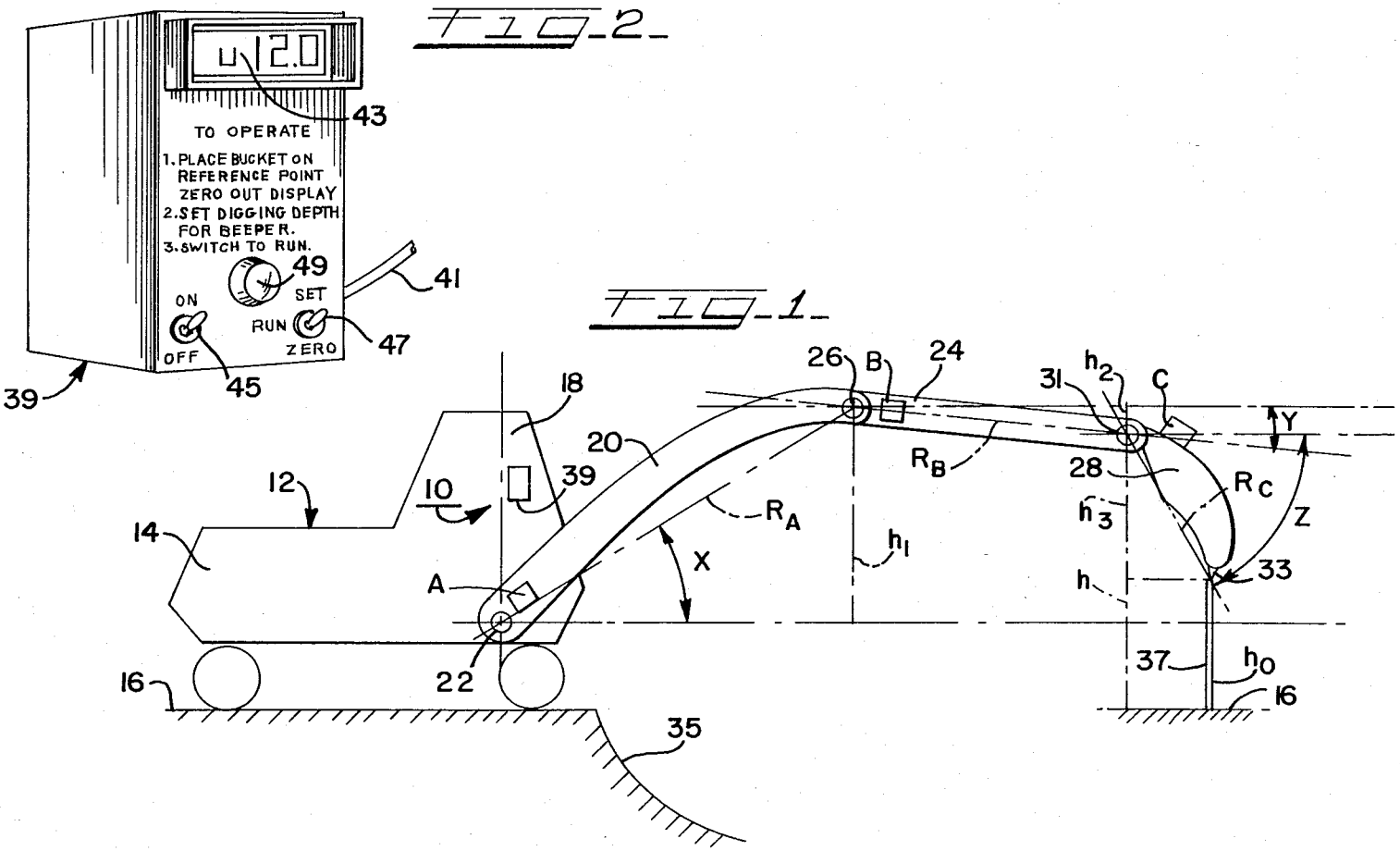
FIG. 1 is a schematic drawing of a digging machine which has mounted on it a depth measuring system, which is constructed in accordance with the present invention.
FIG. 2 is a pictorial view of a console of the system of FIG. 1.

Referring now to FIGS. 1 and 2 of the drawings, there is shown a depth measuring system 10, which is constructed in accordance with the present invention and which is mounted on a digging machine, in the form of a backhoe 12. While the system 10 is shown and described to be mounted on a backhoe, it will become apparent to those skilled in the art that the system 10 may also be employed with other different types and kinds of digging machines which may be mounted on wheels, tracks or even barges. The system 10 of the present invention enables the depth of the hole being dug by the machine 12 to be measured continuously in a highly accurate manner to reduce human error in the depth measurement, thereby increasing the quality of the work and by eliminating or at least greatly reducing the delays associated with manual measuring techniques.

The machine 12 includes a body 14 movably mounted on the ground 16 and having a cab 18. An elongated boom 20 is pivotally mounted about a horizontal axis at 22 at one end of the body 14. At the free end of the boom 20, a dipperstick 24 is pivotally attached about a horizontal axis to the boom 20 at 26. A digging bucket 28 is pivotally attached about a horizontal axis at the opposite end of the dipperstick 24 at 31, the opposite end of the bucket 28 having digging teeth for excavation purposes to dig into the ground 16 to form a hole 35 therein.

The depth of the hole 35 to be dug is measured from the top edge of a vertical surveyor stick or stake 37 implanted in the ground 16 to serve as a reference or guide. The stick has a vertical height $h_o$ above the level of the ground 16.

The system 10 generally comprises a console 39 mounted in the cab 18 of the machine 12 connected electrically via a cable 41 (FIG. 2) to a set of three inclinometer sensors A, B and C mounted on the machine 12. The sensor A is mounted on the boom 20 near the pivot point 22, the sensor B is mounted on the dipperstick 24 near the pivot point 26, and the sensor C is mounted on the bucket 28 near the pivot point 31. The sensor A generates an electrical signal proportional to the slope angle X of the boom 20 relative to a horizontal plane as indicated in FIG. 1 of the drawings. Similarly, the sensor B generates an electrical signal proportional to the slope angle Y of the dipperstick 24 relative to a horizontal plane. In like manner, the sensor C generates an electrical signal proportional to the slope angle Z of the bucket 28 relative to a horizontal plane. For purposes of discussion, when an element is disposed above the horizontal plane, the slope angle is considered to be negative, and when the element is disposed below the horizontal plane, the angle is assumed to be a positive angle.

The displacement of the bucket 28 is determined as hereinafter described in greater detail by measuring the angles of the various elements of the machine 12 relative to a horizontal plane. In this regard, the sensors A, B and C generate electrical signals which are supplied to the console 39, which in turn calculates continuously the relative displacement of the bucket 28 relative to a horizontal plane and displays the information by a four-digit display 41 (FIG. 2). As shown in FIG. 2 of the drawings, the left-most digit represents the relative position of the digging teeth 33 of the bucket 28 relative to a horizontal plane extending through the pivot point 22, and in this regard, the letter "u" designates that the bucket teeth 33 are disposed above the horizontal plane extending through the pivot point 22, the absence of a display of the letter "u" indicating that the bucket teeth 33 are disposed below the horizontal plane extending through the pivot point 22.

In order to start the system 10, an ON-OFF switch 45 on the front panel of the console 39 supplies power to the console 39. Thereafter, the bucket teeth 33 are moved into engagement with the top edge of the stake 37 as shown in FIG. 1 of the drawings. In so doing, the height of the stake 37 is displayed at the display panel 43, and as shown in FIG. 2 of the drawings, is 12 feet in this example. The height of the stake 37 is designated in FIG. 1 as the initial reference height $h_o$. Thereafter, a three position selector switch 47 on the front panel of the console 39 is moved manually into the "ZERO" position to establish a reference height as hereinafter described in greater detail. The height of the stake $h_o$ is thus stored in the console 39 and the value of the initial height $h^o$ is subtracted automatically to provide each reading displayed on the display panel 43 thereafter as hereinafter described in greater detail.

Thereafter, the switch 47 may be moved upwardly into the "SET" position so that a manually operable knob 49 on the front panel of the console 49 may be rotated to preselect or set a desired depth of the hole to be dug by the machine 12. In this regard, as hereinafter described in greater detail, by turning the knob 49, the last reading on the display panel 43 is changed continuously until the desired depth is read from the display panel 43. Thereafter, the operator stops turning the knob or control switch 49 so that the last value of depth is then stored in the console 39 as hereinafter described in greater detail. The switch is then moved into an intermediate or "RUN" position so that the digging operation can commence and the vertical displacement of the bucket 28 can be monitored continuously by viewing the read-out of the display 43. As hereinafter described in greater detail, once the bucket teeth 33 move to a position below the horizontal plane extending through the pivot point 22, the console 39 causes the speaker 52 (FIG. 3) to sound an audible "beeper" of sound to serve as an attention-attracting signal for the operator, whereby the operator then realizes that the desired depth has been reached. Simultaneously therewith, the character of the display 43 is illuminated intermittently to provide a blinking visual signal, whereby both an audio and a visual indication is given to the operator.

Once the hole has been excavated to the desired depth and the beeper has been sounded, the operator of the machine 12 backs it away from the hole so that further excavation can commence. Prior to digging further, the bucket teeth 33 are positioned at the bottom of the freshly excavated hole so that a reading can be taken of its depth with the body 14 of the vehicle positioned at a new location. This new position of the machine 12 may be higher or lower than its original starting position, and therefore the reading may be different from the original set depth. For example, if the desired depth is 20 feet, with the bucket teeth 33 disposed at the bottom of the freshly dug hole, and the body 14 of the machine 12 being disposed at a higher elevation, the reading may be 22 feet on the display 43. Therefore, the operator then moves the switch 47 to the "SET" position and the switch 49 is rotated to advance the reading from the previously set indication of 20 feet to 22 feet. Thereafter, the operator can again commence an excavation operation until the beeper is sounded. This operation is repeated until the entire hole is excavated, such hole being a foundation or the like. It is to be understood that when the machine 12 moves backwardly to excavate further, the vehicle 12 may assume an inclined position longitudinally, and such a position does not affect adversely the set operation of the system 10.

Considering now the technique for calculating the relative displacement of the bucket 28 with particular reference to FIG. 1 of the drawings, once the switch 45 is moved to the "ON" position and the switch 47 is disposed in the "RUN" position, a continuous readout from the display 43 is obtained. In this manner, the console 39 continuously calculates the position of the digging teeth 33 of the bucket 28 relative to the horizontal plane extending through the pivot point 22. In order to accomplish this calculation in a manner which greatly reduces the possibility of error, the following geometric equations are employed:

$$h = h_1 + h_2 + h_3$$

$$h = R_A \text{Sine } X + R_B \text{Sine } Y + R_C \text{Sine } Z$$

$$D = h - h_o$$

The distance h is the actual measured depth and is the sum of three components. The distance $h_1$ is the distance between the pivot point 26 and the horizontal plane extending through the pivot point 22 for the boom 20. The distance $h_2$ is the distance between the axis of the pivot point 31 and the horizontal plane extending through the pivot point 26. Similarly, the distance $h_3$ is the distance between the axis of the pivot point 31 and a horizontal plane extending through the tip of the digging teeth 33 of the bucket 28.

Each one of these three height components may be geometrically expressed in terms of a sine relationship. In this regard, the height $h_1$ is equal to the radial distance $R_A$, which is the distance between the axes of the pivot points 22 and 26 at opposite ends of the boom 20. The angle X is the angle between the radial distance $R_A$ and the horizontal plane extending through the axis of the pivot point 22. Similarly, the height $h_2$ is equal to the radial distance $R_B$ times the sine of the angle Y. The radial distance $R_B$ is the distance between the axes of the pivot points 26 and 31 of the dipper stick 24. The angle Y is the angle between the radial distance $R_B$ and the horizontal plane extending through the axis of the pivot point 26. The height component $h_3$ is equal to the product of the radial distance $R_C$ times the sine of the angle Z. The radial distance $R_C$ is equal to the straight line distance between the axis of the pivot point 31 and the tip of the digging teeth 33 of the bucket 28. The angle Z is the angle between the radial distance $R_C$ and the horizontal plane extending through the pivot point 31.

The depth D is the displayed depth which is the value of the depth shown on the display 43. The display depth D is equal to the measured depth h less the initial height $h_0$. As shown in the example of FIG. 1 of the drawings, the initial height $h_0$ for reference purposes is the height of the surveyor stake 37. It is to be understood that any initial reference height may be used, but for convenience purposes the depth of the hole to be excavated is oftentimes measured from a reference point at the top of a surveyor's stake, such as the stake 37.

By employing the above-mentioned geometrical equations, according to the present invention there are several very important advantages derived therefrom. Firstly, it will be apparent to those skilled in the art that each one of the components of the equation for arriving at the measured depth h is based upon the measurement of a single angle. Thus, any error in the measurement of that angle is not compounded. In this regard, there is no need to add together two or three measurements of two or three different angles as performed in the prior art, thereby causing the possibility of cumulative error to result. Therefore, the calculations of the present invention are performed in such a manner that any errors introduced into the calculations are maintained at a minimally acceptable level.

Secondly, by employing the equations of the present invention, the third component $h_3$ for the bucket 28 is usually a constant, and therefore, in many, if not most, applications of the system 10 there is no need for the sensor C. In this regard, during the normal digging operation of the machine 12, the angle Z remains fixed and constant since most types of digging equipment of this type are designed so that the angle Z remains constant to maximize the effectiveness of the digging of the bucket 28. Such an advantage is twofold. Mainly, the cost of the system 10 is reduced by the elimination of one of the sensors, and it is highly desirable to eliminate the need for a sensor mounted on the bucket 28 since such a sensor is exposed to excessive stresses and forces during the digging operation and tends to malfunction and break. Thus, henceforth, we we will assume that the sensor C is optional, and that the height $h_3$ is a constant and such information is stored in the console 39.

A further advantage derived from the use of the equations of the present invention is that only one kind of sensor need be employed. In this regard, each one of the sensors is an inclinometer sensor. As a result, manufacturing and inventory requirements are readily simplified.

Figure 4:
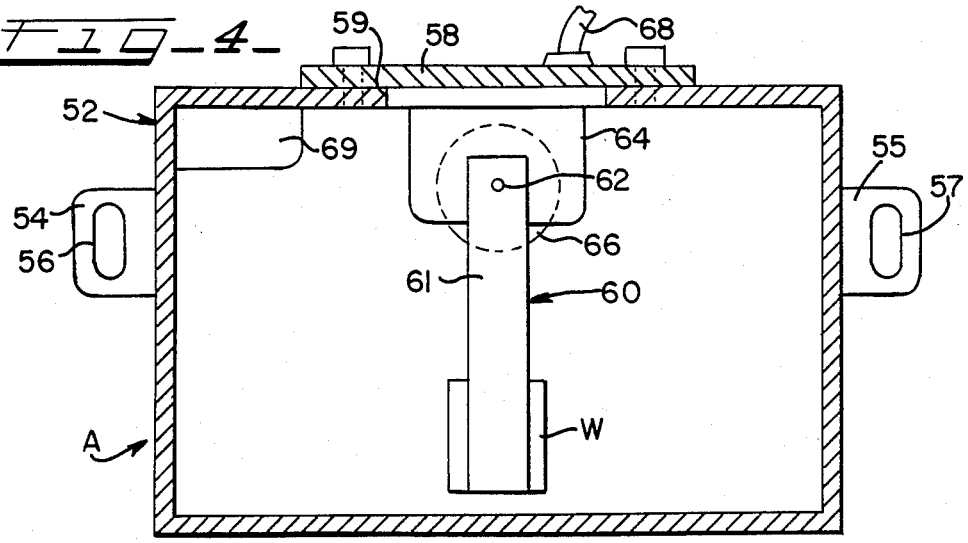
FIG. 4 is a cross-sectional elevational view of an inclinometer sensor shown in FIG. 1.

Considering now the inclinometer sensors in greater detail with particular reference to FIG. 4 of the drawings, the sensors A, B and C are identical to one another, and therefore, only the sensor A will now be described in greater detail. The sensor A generally comprises a sealed housing 52 which has a hollow interior and which has a pair of external mounting flanges or ears 54 and 55. The flanges 54 and 55 have respective elongated slots or holes 56 and 57 which enable sensor A to be mounted in position on the boom 20 and positionally adjust it. In this regard, each one of the slots extends vertically and is adapted to receive bolts (not shown).

A bolted-on cover 58 is positioned over and seals an access opening 59 in the housing 52. The interior of the housing is filled with a suitable viscous fluid. In this regard, in order to detect the angle of the sensor's housing 52 relative to the vertical, a pendulum or plumb device 60 is critically damped by the viscous fluid. The pendulum 60 includes an elongated vertical member 61 which is swingably mounted at its upper end about a pivot point 62 extending through a boss 64. A weight W is fixed at the lower end of the elongated member 61 so that the elongated member 61 assumes a true vertical disposition even though the housing 52 may move back and forth about an axis perpendicular to the plane of the paper. In this regard, the elongated member 61 is able to swing back and forth relative to the boss 64 which is fixed to the housing 52 about the pivot point 62.

A potentiometer 66 is mounted on the boss 64 and is driven by the pendulum 60, whereby the potentiometer 66 generates an electrical signal and transmits it via a cable 68 to the cable 41 of the console 39 as hereinafter described in greater detail. The electrical signal generated by the potentiometer 66 in response to the movement of the pendulum 60 is proportional to the boom slope angle X.

A flexible compartment 69 at the inside of the housing 62 is adapted to take up expansion and contraction of the fluid disposed within the housing 52.

Figure 3:
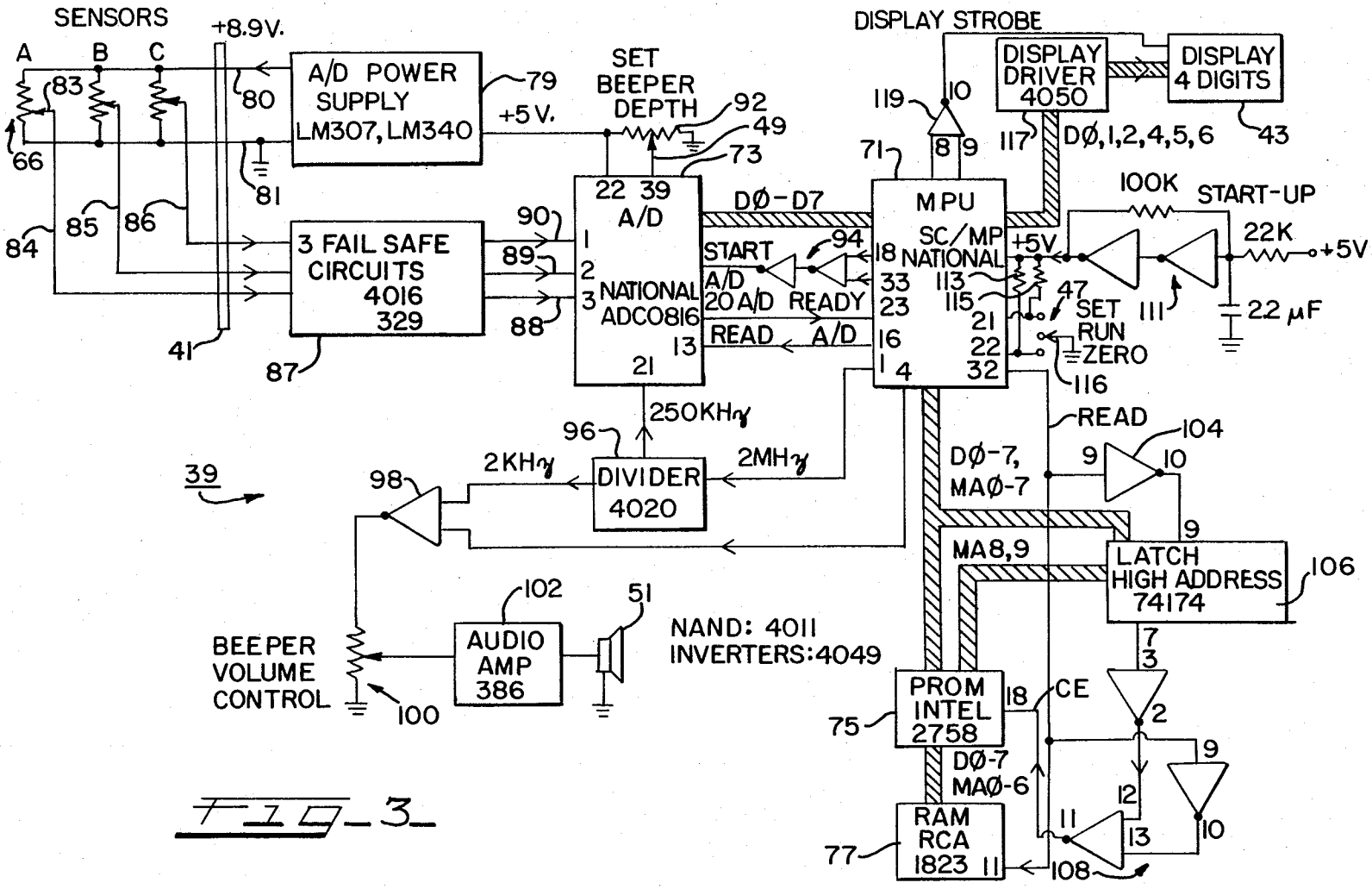
FIG. 3 is a symbolic block diagram of the system of FIG. 1.

Considering now the console 39 in greater detail with particular reference to FIG. 3 of the drawings, the electronic hardware circuitry of the console 39 will now be described. As shown in FIG. 3 of the drawings, the major components of the console 39 are integrated circuits which are shown as rectangular boxes having disposed therewithin their identification numbers and significant terminal designations. The console 39 generally comprises a microprocessor unit 71 which is used, amongst other things, to calculate the displayed depth D. An analog-to-digital converter 73 converts the analog signals from the sensors A, B and C, as well as the signal from the set beeper control switch 49, to digital signals for use by the microprocessor unit 71 as hereinafter described in greater detail. A programmable read-only memory 75 is used to store code program information as well as table information as shown in Appendix A. Such program information is used by the microprocessor unit to control various different operations of the system 10. A random access memory 77 is provided and is used by the microprocessor unit in carrying out the various different functions of the console 39. As shown in FIG. 3 of the drawings, a bi-directional 8 bit data bus conveys 8 data bits D0–D7 to be used by the console 39. There is also a 10 bit address bus MA0–MA9. The two buses are shown as cross-hatched cables in FIG. 3 of the drawings.

An analog-to-digital converter power supply 79 is provided to generatate a 5-volt signal to supply it to the analog-to-digital converter 73 as well as provided a bias potential for the set beeper depth potentiometer 92 associated with the manually operable switch 49 on the front panel of the console 39. The power supply 79 also provides an 8.9 volt potential across a pair of leads 80 and 82 which form a part of the cable 41 to provide biasing potential across the sensors A, B and C so that the three wipers, such as the wiper 83 for the potentiometer 66 of the sensor A, generate analog signals varying between ground and 8.9 volts. Three leads 84, 85 and 86 supply the analog signals of the three wipers of the sensors A, B and C via the cable 41 to three similar fail-safe circuits designated generally as 87, which, in turn, supply the signals to the analog-to-digital converter 73 via three leads 88, 89 and 90 to the terminals 3, 2 and 1, respectively, of the converter 73. As hereinafter described in greater detail, the fail-safe circuits ensure that the maximum analog signal supplied via the leads 88, 89 and 90 to the converter 73 is 5 volts to prevent damage to the converter 73 as hereinafter described in greater detail in connection with the description of FIG. 6 of the drawings.

Considering now the converter 73 in greater detail, the converter 73 is an integrated circuit identified as ADCO 816 manufactured by National Semiconductor Corporation and includes a 16 channel multiplexer and microprocessor compatible control logic. A set of logic gates 94 have their inputs connected to the terminals 18 and 33 of the microprocessor unit 71 for generating a signal START A/D for the converter 73 to serve as a request signal. Thereafter, a signal A/D READY is generated at the terminal 20 of the converter 73 and supplied to the terminal 23 of the microprocessor unit 71. Thereafter, when the microprocessor unit 71 is ready to receive data from the converter 73, a signal READ A/D is supplied from the terminal 16 of the microprocessor unit 71 and supplied to the terminal 13 of the converter 73. Thereupon, 8 data bits D0–D7 are supplied from the converter 73 to the microprocessor unit 71. A divider 96 supplies a 250 KHz clock signal to the terminal 21 of the converter 73, and the divider 96 receives a 2 MHz clock signal from the terminal 1 of the microprocessor unit 71. A NAND date 98 provides a 2 KHz signal from the divider 96 upon the receipt of a control signal from the terminal 4 of the microprocessor unit 71 through a beeper volume control potentiometer 100 and an audio amplifier 102 to the speaker 51 for generating the beeper audio signal.

In order to access the random access memory 77, a signal READ is generated by the microprocessor unit 71 and supplied from its terminal 32 directly to a terminal 11 of the memory 77. The memory address information is contained in the signals MA0–MA6 from the address bus. The data signals D0–D7 are communicated between the microprocessor unit 71 and the memory 77.

In order to access the programmable read-only memory 75, the signal READ not being through from the microprocessor unit 71 is supplied through an inverter gate 104 to a latch high address circuit 106. The purpose of this circuit is to latch the two highest memory address bits MA8 and MA9 to supply them together with the memory address bits MA0–MA7 to the programmable read-only memory 75. Also, a set of logic gates 108 are connected to a terminal 7 of the integrated circuit 106 to supply a signal CE (chip enable) to the terminal 18 of the memory 75 for requesting the access thereof. As a result, information is read from the memory 75 and supplied via the data bus to the unit 71.

A start-up circuit 111 is activated once the ON-OFF switch 45 is turned to its ON position. The purpose of the circuit 111 is to provide a delay in the starting up of the unit 71 for initialization purposes. After a predetermined time delay interval, +5 volts is supplied to the unit 71 and to the ZERO terminal and the SET terminal of the 3-position switch 47 via the respective resistors 113 and 115 to the respective terminals 22 and 21 of the unit 71. It should be noted that the RUN terminal of the switch 47 is unterminated and the wiper 116 is grounded. As a result, when the wiper 116 is moved to either the SET or the ZERO positions, a ground signal (logic level 0) is supplied as a flag to the terminals 21 and 22, respectively.

A display driver 117 conveys data signals D0, D1, D2, D4, D5 and D6 to the display 43 when a signal DISPLAY STROBE is generated by means of a NAND gate 119 energized by the unit 71 for 43. In the preferred form of the present invention, the display 43 includes incandescent lamps (not shown) so that the display can be rendered visible in sunlight. However, it is to be understood by those skilled in the art that other different types and kinds of displays may also be employed.

Figure 5:
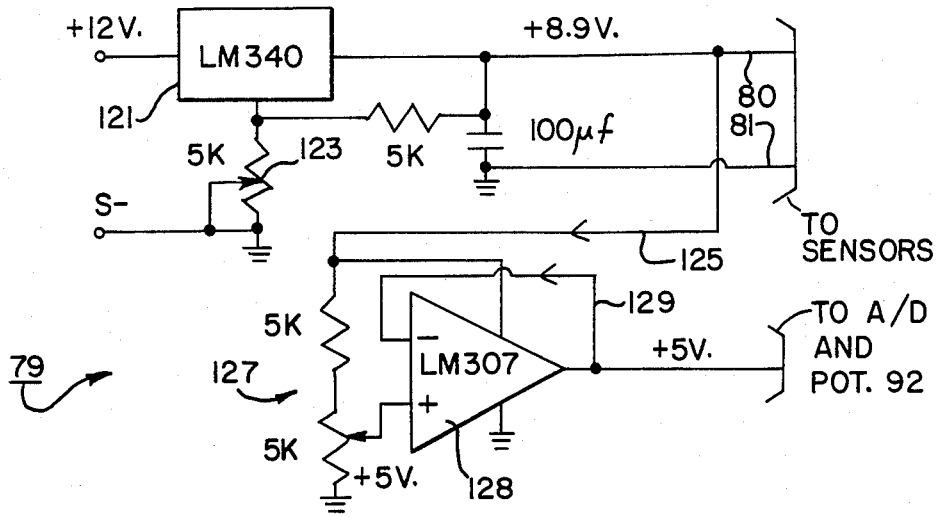
FIG. 5 is a symbolic block diagram of the analog-to-digital converter power supply.

Referring now to FIG. 5 of the drawings, there is shown the analog-to-digital power supply 79. The power supply 79 generally comprises a power supply integrated circuit 121 which is energized by +12 volts to generate the 8.9 volts supply signal on the lead 80 for the sensors, the lead 81 being connected to ground. A potentiometer 123 is manually adjustable to control the value of the output voltage from the circuit 121. In this manner, the voltage across the leads 80 and 81 can be adjusted and therefore the voltage across the potentiometers of the sensors can be controlled. As a result, the pendulum-controlled wipers, such as the wiper 83, for the sensor potentiometers for a given machine, such as the machine 12, is limited in its range of motion; for example, 180°. Therefore, knowing the range of motion of the wipers of the potentiometer of the sensors, and knowing the maximum voltage acceptable for the analog-to-digital converter 73 (for example, +5 volts), the potentiometer 123 of the power supply circuit 79 can be adjusted manually to provide the proper biasing potential across the sensor potentiometers so that the maximum excursion of their wipers produces an analog signal of a maximum of +5 volts which is the maximum acceptable voltage for the converter 73. Thus, in effect, each one of the sensor potentiometers has an electronically adjustable tap which can be varied depending upon the mechanical excursion of the wipers of the potentiometers for a given digging machine. For example, if the maximum excursion is 90°, the potentiometer 123 is adjusted to double the output voltage to approximately +17.8 volts. In this manner, at the maximum excursion of the potentiometer wipers, the 90° excursion produces a +5 volts signal. Therefore, the maximum analog signals produced by the sensors can be conveniently adjusted manually for any given range of motion of a particular digging machine in accordance with the present invention.

As shown in FIG. 5 of the drawings, a lead 125 connects the output lead 80 of the circuit 121 to a resistor voltage divider network 127 to provide a +5 volt reference for the plus terminal of a differential amplifier 128, which has its output connected via a lead 129 back to its negative input. The output of the differential amplifier 128 is also connected to the converter 73 and the set beeper depth potentiometer 92 (FIG. 3). Thus, the differential amplifier 128 serves as a voltage follower to maintain the signal level to the converter 73 at the desired voltage level. Also, it should be noted that the output of the power supply circuit 121 is connected to both the sensors and the converter 73 so that should the output voltage of the power supply 121 vary due to noise or otherwise, the reference potential for the converter 73 is tied to the biasing potential for the sensors, whereby should a change in the output voltage of the circuit 121 occur, both the biasing potential for the sensors and the reference potential for the converter 73 change by a proportional amount.

Figure 6:
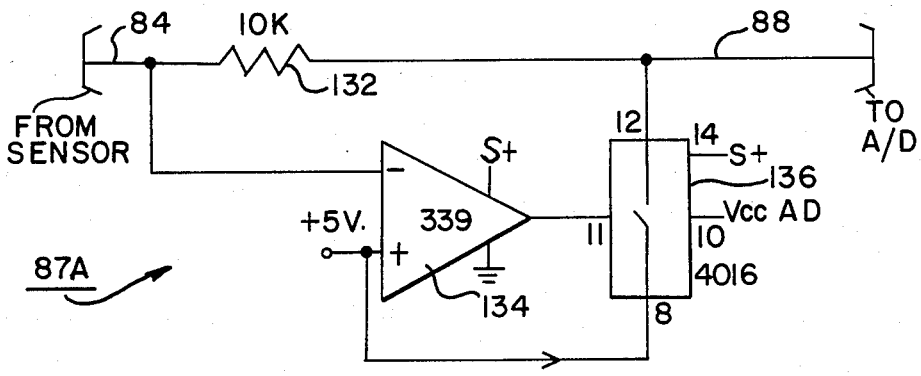
FIG. 6 is a symbolic block diagram of one of the fail-safe circuits of the system of FIG. 3.

Referring now to FIG. 6 of the drawings, there is shown a fail-safe circuit 87A which is one of the three fail-safe circuits designated generally by the reference character 87 in FIG. 3 of the drawings, the other two fail-safe circuits being identical to the one shown in FIG. 6 of the drawings. The circuit 87A includes a resistor 132 which interconnects the lead 84 from the wiper 83 of the potentiometer 66 of the sensor A to the output lead 88 to the converter 73. In this manner, during normal operation, the boom slope angle analog signal from the wiper 83 is connected through the resistor 132 directly to the converter 73 via the lead 88. However, should the maximum excursion of the analog signal exceed the maximum acceptable signal of +5 volts for the converter 73, a differential amplifier 134 having its negative input connected to the lead 84 and having its positive input connected to a +5 volt reference generates an output signal for causing an integrated switching circuit 136 to connect the +5 volts reference potential to the lead 88 for clamping it to +5 volts. In this manner, the signal connected to the lead 88 for the converter 73 never exceeds the reference potential of +5 volts.

Figure 7:
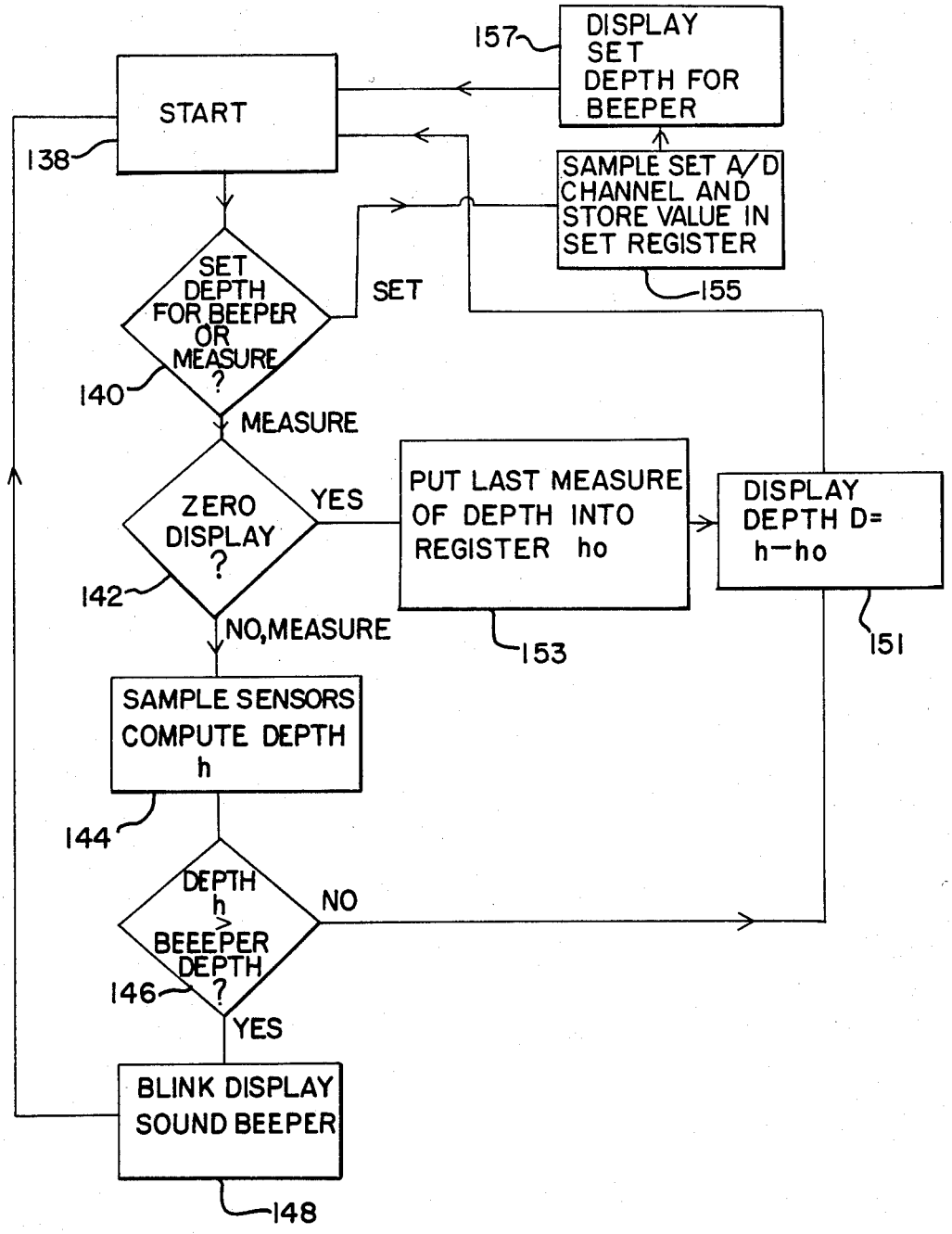
FIG. 7 is a flow chart of the program for the system of FIG. 3.

Referring now to FIG. 7 of the drawings, there is shown a flow chart of the program information stored in the programmable read-only memory 75 and shown in listing form in Apendix A. The operation is started at state 138 by turning on the power by means of a switch 45. A measuring operation commences following the time delay produced by the start-up circuit 111 (FIG. 3). In this regard, a decision state 140 is entered to determine whether a measurement is to be taken or a depth setting operation for the beeper is to be performed as a result of the SET position of the switch 47. Assuming that a measurement operation is to take place, the decisional state 142 is entered to determine whether or not a reference zero operation is to take place as determined by the position of the switch 47. Assuming that such a zero reference operation is not to take place, and the switch 47 is disposed in its RUN position, the state 144 is entered.

In the state 144, the sensors are sampled via the converter 73 to determine the value of the signals produced by the potentiometers of the sensors, since the value of those signals is proportional to the slope angles of the various elements of the machine 12 as hereinbefore described in detail in connection with the geometric calculations according to the present invention. In this regard, assuming that the height component $h_3$ is a constant (sensor 3 is not used), only the signals from the two sensors A and B are used to calculate the height h. Thereafter, the decisional state 146 is entered to determine whether or not the calculated depth is greater than the pre-set beeper depth. If it is equal to or greater than the beeper depth, the state 148 is entered to cause the leftmost character of the display 43 to blink intermittently to provide the visual attention-attracting signal, and the beeper speaker 51 is energized as a result of a signal from the terminal 4 of the microprocessor unit 71 for enabling the gate 98 of FIG. 3. Thereafter, the starting state 138 is entered. If the depth h is less than the preset beeper depth, a state 151 is entered to calculate the display depth D by subtracting the initial reference height $h_0$. Once the display depth D is calculated and the display 43 is energized to provide the depth information, the starting state 138 is entered.

Considering now the initial reference zero operation, when the switch 47 is disposed in its ZERO position, when the decisional state 142 is entered, the reference zero operation is determined by the switch 47. As a result, the state 153 is entered to store the last measured value of the depth h in the register designated $h_0$ for storing the initial reference height $h_0$. From there, the state 151 is entered to display the current value of the depth. Initially, at this point in the operation, h is equal to $h_0$, and therefore, the display depth D is equal to 0. Therefore, the initial display is 0.

Assuming a set beeper depth operation, once the decisional state 140 is entered and the switch 47 is disposed in its SET position, a transition is made to the state 155 in which the analog-to-digital converter channel for the set beeper depth signal from the potentiometer 92 is sampled. The current value of the setting of the potentiometer 92 is then stored in the SET register. Thereafter, the state 157 is entered to display the current value of the potentiometer 92. From there, the starting state 138 is entered. In this manner, as the operator turns the knob or wiper 49 for the potentiometer 92 to change the value of the depth being displayed, a transition occurs between the states 138, 140, 155 and 157 until the operator stops turning the knob or wiper 49 and then moves the switch 47 to the RUN position. Thus, the operator notices a change in the reading on the display 43 continuously as he turns the knob or wiper 49.

After moving the switch 47 to the RUN position, the display depth D is indicated visually by the display 43 as the bucket 28 moves upwardly or down- wardly.

Considering now the operation of the system 10, once the switch 45 is turned ON, after the predetermined start-up interval determined by the circuit 111, the console 39 moves from the initial state 138 through the states 140 and 142 to the state 144 to calculate the depth h. In this state, the sensors are sampled via the converter 73. In this regard, the signal START A/D is generated by the logic circuits 94 and supplied to the converter 73. An address is supplied to the converter 73 via the data bus bits D0–D3. Thereafter, the signal READ A/D is generated by the converter 73 and supplied to the unit 71. Thereafter, the data bits D0–D7 are transmitted from the converter 73 via the bus to the microprocessor unit 71. That information is then stored in the random access memory 77 by addressing it via the memory address bits MA0–MA9 when the signal READ is generated by the unit 71 and transmitted directly to the memory 77.

A program sub-routine is then performed by the unit 71 in response to the program information stored in the programmable read-only memory 75 by using the random access memory 77. For example, reference may be made to the listing in Appendix A under the comment "Compute the depth" and the following comments. It should be noted that under the comments "Test if channel A sensor. If so, subtract 90° before looking in table.", the reading of the sensor has to be adjusted as a result of the mechanical position of that sensor relative to the vertical position thereof.

After computing the depth h, the decisional state 146 is entered and the determination is made as to whether or not the depth h is greater than the beeper depth. For this purpose, the code for accomplishing that is found in Appendix A under the comment "Test if the depth has been reached". Assuming that the depth has not been reached, the state 151 is entered and the display depth D is computed by subtracting the initial depth $h_0$ from the thus calculated depth h. Thereafter, the depth D is illuminated on the display 43 by causing the signal DISPLAY STROBE by the logic gate 119 and transmitting it to the display 43 so that the data D0-2 and D4-6 transmitted to the display 43 via the display driver 117. Thereafter, the state 138 is re-entered.

As mentioned previously, the reference zero operation is commenced by the movement of the switch 47 to the ZERO position to record the present calculated depth h in the register $h_0$ during state 153. In order to initiate a set operation, the switch 47 is moved to the SET position so that a transition can be made from the state 140 to the state 155. During that operation, the potentiometer knob or wiper 49 can be rotated to set a desired depth.

APPENDIX A

*D800.DBFF

| | | | | | | | | |
|---|---|---|---|---|---|---|---|---|
| D800- | C0 | 01 | 1D | 30 | 11 | FF | FF | FF |
| D808- | FF | FF | FF | FF | FF | FF | FF | FF |
| D810- | FF | 36 | 4A | D4 | 00 | 7A | 3F | 24 |
| D818- | F8 | 13 | A8 | E8 | 8F | 73 | 9F | 73 |
| D820- | D4 | 01 | A8 | 12 | D4 | 02 | 5D | 10 |
| D828- | 12 | F8 | 06 | A8 | 9F | 58 | 18 | 8F |
| D830- | 58 | C0 | 03 | B6 | F8 | 06 | A8 | 08 |
| D838- | BF | 18 | 08 | AF | D4 | 02 | 5D | 10 |
| D840- | 08 | 30 | 73 | 30 | D8 | D4 | 01 | 97 |
| D848- | 30 | 03 | F8 | 00 | AF | D4 | 01 | 50 |
| D850- | C4 | F8 | 0E | AD | F8 | 02 | 5D | 1D |
| D858- | F8 | 00 | 5D | 2D | D4 | 02 | 78 | D4 |
| D860- | 02 | C6 | F8 | 08 | A8 | 9F | 58 | 18 |
| D868- | 8F | 58 | D4 | 02 | 0A | D4 | 01 | A8 |
| D870- | 08 | 30 | D8 | 9F | FE | 3B | 45 | 30 |
| D878- | D8 | 8D | F8 | 06 | A8 | F8 | 00 | 58 |
| D880- | 18 | 58 | D4 | 00 | 93 | 01 | 04 | D4 |
| D888- | 00 | 93 | 02 | 05 | D4 | 00 | 93 | 03 |
| D890- | 06 | D5 | C4 | 46 | B1 | 46 | A1 | 91 |
| D898- | AF | C4 | C4 | C4 | D4 | 01 | 50 | 91 |
| D8A0- | FF | 01 | 3A | A9 | D4 | 02 | 5D | 03 |
| D8A8- | F6 | D4 | 02 | DE | F8 | 02 | A8 | 9F |
| D8B0- | 58 | 18 | 8F | 58 | F8 | 10 | BD | F8 |
| D8B8- | 02 | AD | 81 | AF | C4 | C4 | C4 | D4 |
| D8C0- | 01 | 50 | D4 | 02 | 78 | D4 | 02 | C6 |
| D8C8- | D4 | 02 | 5D | 10 | 06 | F8 | 06 | A8 |
| D8D0- | 9F | 58 | 18 | 8F | 58 | D5 | 01 | 66 |
| D8D8- | D4 | 01 | 5E | 30 | 30 | 03 | BD | AD |
| D8E0- | F8 | F4 | AD | D4 | 02 | 78 | D4 | 02 |
| D8E8- | C6 | D4 | 02 | 0A | F8 | 10 | BF | 30 |
| D8F0- | 34 | AF | D4 | 02 | 0A | 30 | 03 | 0A |
| D8F8- | 30 | 03 | F7 | 2A | 9A | D5 | 30 | 0F |
| D900- | D3 | E2 | 96 | 73 | 86 | 73 | 93 | B6 |
| D908- | 83 | A6 | 46 | B3 | 46 | A3 | 30 | 00 |
| D910- | D3 | 96 | B3 | 86 | A3 | E2 | 12 | 72 |
| D918- | A6 | F0 | B6 | 30 | 10 | F8 | 00 | A6 |
| D920- | A7 | A8 | A9 | B3 | F8 | 10 | BA | BB |
| D928- | BC | BD | BE | BF | AA | AB | AC | AD |
| D930- | AE | AF | B6 | B7 | B8 | B9 | B2 | F8 |
| D938- | 01 | B4 | A4 | B5 | F8 | 11 | A5 | F8 |
| D940- | 03 | A3 | F8 | 1F | A2 | C0 | 01 | BA |
| D948- | 34 | 48 | 69 | AF | F8 | 00 | BF | D5 |
| D950- | F8 | 0C | A8 | 8F | 58 | E8 | 62 | D4 |
| D958- | 01 | 5E | 02 | 30 | 48 | 34 | 46 | B9 |
| D960- | 29 | 99 | 3A | 60 | D5 | 30 | E8 | F8 |
| D968- | 0A | A8 | 08 | FA | 02 | 3A | 73 | F8 |
| D970- | 6C | 30 | 75 | F8 | 6F | 58 | 64 | 08 |
| D978- | 3A | 7C | F8 | 0F | FC | 40 | 58 | 64 |
| D980- | 08 | FC | 30 | 58 | 64 | 64 | D5 | 0A |
| D988- | 73 | 27 | 87 | FC | 30 | 58 | 64 | 64 |
| D990- | F8 | 6F | 58 | 64 | 28 | 28 | D5 | 7B |

-continued

APPENDIX A

*D800.DBFF

| | | | | | | | | |
|---|---|---|---|---|---|---|---|---|
| D998- | E3 | 64 | 6A | D4 | 01 | 5E | 20 | 7A |
| D9A0- | E3 | 64 | 6B | D4 | 01 | 5E | 20 | D5 |
| D9A8- | 46 | C4 | A8 | 48 | FB | FF | B9 | 08 |
| D9B0- | FB | FF | A9 | 19 | 89 | 58 | 28 | 99 |
| D9B8- | 58 | D5 | F8 | 12 | A8 | F8 | 00 | 58 |
| D9C0- | 18 | 58 | F8 | 08 | A8 | F8 | FE | 58 |
| D9C8- | 18 | F8 | 01 | 58 | F8 | 00 | A8 | D3 |
| D9D0- | FF | FF | FF | FF | FF | FF | FF | FF |
| D9D8- | FF | FF | FF | FF | FF | FF | FF | FF |
| D9E0- | FF | FF | FF | FF | FF | FF | FF | FF |
| D9E8- | FF | FF | FF | FF | FF | FF | FF | FF |
| D9F0- | FF | FF | FF | FF | FF | FF | FF | FF |
| D9F8- | FF | FF | FF | FF | FF | FF | FF | FF |
| DA00- | F8 | 01 | B9 | F8 | 66 | A9 | F8 | 0A |
| DA08- | 30 | 0D | 30 | 00 | C4 | AA | F8 | 03 |
| DA10- | AB | C4 | BB | F8 | 0F | AD | 9F | FE |
| DA18- | F8 | 0B | 3B | 29 | 8F | FD | 00 | AF |
| DA20- | 9F | 7D | 00 | BF | F8 | 0D | C8 | F8 |
| DA28- | 00 | 5A | 8B | 32 | 32 | 1A | 2B | 30 |
| DA30- | 27 | E8 | 9B | AB | 8F | FE | AF | 9F |
| DA38- | 7E | BF | 0A | 7C | 00 | 5A | 8D | 3A |
| DA40- | 42 | D9 | 0A | 7E | 5A | FF | 0A | 3B |
| DA48- | 4A | 5A | 2A | 2B | 8B | 3A | 42 | 33 |
| DA50- | 41 | 2D | 9B | 52 | 8A | F4 | AA | 9A |
| DA58- | 7C | 00 | BA | 30 | 32 | 46 | BD | 46 |
| DA60- | AD | ED | 9F | F3 | FB | 80 | 52 | 1D |
| DA68- | 8F | F4 | AF | 2D | 9F | 74 | BF | 02 |
| DA70- | FE | 3B | 76 | 9F | F3 | FE | D5 | FF |
| DA78- | ED | 9F | F3 | FA | 80 | BC | F8 | 10 |
| DA80- | AC | F8 | 00 | BE | AE | 2C | 9F | F6 |
| DA88- | BF | 8F | 76 | AF | 9E | 3B | 9B | 1D |
| DA90- | 8C | 3A | 9E | 8E | F7 | AE | 2D | 9E |
| DA98- | 77 | BE | 9C | FE | 30 | A8 | 8E | F4 |
| DAA0- | AE | 2D | 9E | 74 | BE | CF | F0 | FE |
| DAA8- | 9E | 76 | BE | 8E | 76 | AE | 3B | B4 |
| DAB0- | 9F | F9 | 80 | BF | 8C | 3A | 85 | 9F |
| DAB8- | FE | 8E | C7 | FB | FF | 3A | C3 | 9E |
| DAC0- | C7 | FB | FF | FC | FF | D5 | 9F | AF |
| DAC8- | 8E | BF | D5 | 91 | FF | 02 | 3A | D1 |
| DAD0- | 2F | D4 | 02 | 5D | 03 | F8 | C0 | 03 |
| DAD8- | 14 | D5 | 9F | 58 | D5 | FF | F8 | 00 |
| DAE0- | A7 | C4 | C4 | C4 | C4 | C4 | C4 | C4 |
| DAE8- | D4 | 02 | 5D | 03 | FE | 17 | 9F | FE |
| DAF0- | 3B | E8 | D4 | 02 | 5D | 03 | F8 | F8 |
| DAF8- | 0E | A8 | 9F | 58 | 18 | 8F | 58 | 9F |
| DB00- | FE | 33 | 0E | D4 | 01 | A8 | 0E | F8 |
| DB08- | 0E | A8 | 48 | BF | 08 | AF | C0 | 02 |
| DB10- | CB | 03 | F8 | C4 | F8 | 03 | BF | 8F |
| DB18- | FC | 36 | AF | F8 | 01 | A8 | 0F | 58 |
| DB20- | F8 | 00 | 28 | 58 | 87 | 76 | 33 | 2C |
| DB28- | D4 | 01 | A8 | 00 | C4 | C4 | F8 | 00 |
| DB30- | A8 | 48 | BF | 08 | AF | D5 | 00 | 03 |
| DB38- | 06 | 09 | 0C | 0F | 13 | 16 | 19 | 1C |
| DB40- | 1F | 22 | 25 | 28 | 2C | 2F | 32 | 35 |
| DB48- | 38 | 3B | 3D | 41 | 44 | 47 | 4A | 4D |
| DB50- | 50 | 53 | 56 | 59 | 5C | 5F | 62 | 65 |
| DB58- | 67 | 6A | 6D | 70 | 73 | 76 | 78 | 7B |
| DB60- | 7E | 80 | 83 | 86 | 89 | 8B | 8E | 91 |
| DB68- | 93 | 96 | 98 | 9B | 9E | A0 | A2 | A5 |
| DB70- | A7 | A9 | AC | AE | B0 | B3 | B5 | B7 |
| DB78- | B9 | BB | BD | C0 | C2 | C4 | C6 | C8 |
| DB80- | CA | CB | CD | CF | D1 | D3 | D5 | D6 |
| DB88- | D8 | DA | DB | DD | DE | E0 | E2 | E3 |
| DB90- | E4 | E6 | E7 | E8 | EA | EB | EC | ED |
| DB98- | EF | F0 | F1 | F2 | F3 | F4 | F5 | F6 |
| DBA0- | F6 | F7 | F8 | F9 | FA | FA | FB | FB |
| DBA8- | FC | FC | FD | FD | FE | FE | FF | FF |
| DBB0- | FF | FF | FF | FF | FF | FF | F8 | 06 |
| DBB8- | A0 | F8 | 00 | B0 | F8 | 10 | BE | BF |
| DBC0- | F8 | 27 | AF | F8 | 25 | AE | 0E | 5F |
| DBC8- | 2E | 2F | 20 | 80 | 3A | C6 | C4 | 1E |
| DBD0- | F8 | 06 | AF | 4F | 5E | 1E | 0F | 5E |
| DBD8- | F8 | 04 | A0 | F8 | 00 | BF | AF | F8 |
| DBE0- | 20 | A8 | 88 | AD | D4 | 02 | 61 | 18 |
| DBE8- | 18 | 20 | 80 | 3A | E2 | F8 | 03 | BD |
| DBF0- | C0 | 00 | E0 | FF | 00 | 40 | 01 | 80 |
| DBF8- | 00 | 80 | FF | 80 | 01 | 00 | FF | 00 |

*

We claim:

1. In a depth-monitoring system for a digging machine having a boom pivotally mounted at one of its ends to a body, a dipper stick pivotally attached at one of its ends to the free end of the boom, and a bucket pivotally attached to the opposite end of the dipper stick and having digging teeth thereon for digging a hole in the ground, an arrangement comprising:

a first inclinometer sensor mounted on the boom for generating a boom slope angle signal proportional to the slope angle of the boom relative to a horizontal plane;

a second inclinometer sensor mounted on the dipper stick for generating a dipper stick slope signal proportional to the slope angle of the dipper stick relative to a horizontal plane;

processor means responsive to said boom slope signal and to said dipper stick slope signal for generating display depth information indicative of the downward displacement of the bucket relative to the body of the machine;

memory means for storing information indicative of the radial length of the boom, for storing information indicative of the radial length of the dipper stick, for storing information indicative of the bucket height, and for storing sine table information for enabling said processor means to calculate the depth information by adding the bucket height, the product of the boom radial length and the sine of the boom slope angle, and the product of the dipper stick radial length and the sine of the dipper stick slope angle; and display means responsive to said depth information for providing a read-out output indicative of said displacement.

2. In a depth-monitoring system, the arrangement according to claim 1, further including manually operable preset means coupled electrically to said processor means for generating information indicative of the value of a desired depth of the hole to be dug, said memory means for storing the last-mentioned information so that said processor means can generate information indicative of the displacement of the bucket being equal to the value of said desired depth, and means responsive to the last-mentioned information for generating an attention-attracting signal.

3. In a depth-monitoring system, the arrangement according to claim 2, further including means supplying said attention-attracting signal to said display means for producing a blinking visual indication, sound-producing means, and means supplying said attention-attracting signal to said sound-producing means for producing an audible indication.

4. In a depth-monitoring system, the arrangement according to claim 1, further including manually operable zero reference means coupled electrically to said processor means for generating a signal initiating a zero referencing operation, and wherein said memory means stores the last-mentioned signal so that said processor means performs a zero referencing operation by recording the instant initial bucket displacement information for enabling said processor means to subtract the value of the initial bucket displacement information from the value of the summing information resulting from said adding.

5. In a depth-monitoring system, the arrangement according to claim 1, further including a third inclinometer sensor mounted on said bucket for generating a bucket slope signal proportional to the slope angle of the bucket relative to a horizontal plane, said memory means for storing the last-mentioned signal and for storing information indicative of the radial length of the bucket so that said processor means computes said information indicative of the bucket height.

6. In a depth-monitoring system, the arrangement according to claim 1, wherein each one of said inclinometer sensors includes a housing, plumb means swingably mounted therein, and potentiometer means drivingly connected to said plumb means for generating its respective slope signal.

7. In a depth-monitoring system, the arrangement according to claim 6, further including power supply means connected electrically to each one of said sensors to provide biasing potential across the potentiometer means thereof, and variable means for adjusting the value of said biasing potential to adjust the magnitude of the signals produced by each one of said potentiometer means.

8. In a depth-monitoring system, the arrangement according to claim 7, further including analogue-to-digital means for converting said boom slope angle signal and said dipper stick slope signal into a digital signal.

9. In a depth-monitoring system, the arrangement according to claim 8, further including means for coupling the output from said voltage supply to both said converter means and to said sensors, and voltage follower means for controlling the value of the voltage supplied to said converter means.

10. In a depth-monitoring system, the arrangement according to claim 9, wherein said means for converting includes inputs, further including switching means for connecting a predetermined potential to the inputs to said converter means, and fail-safe means for monitoring signals from said sensors to energize said switching means when said signals from said sensors exceed said predetermined value.

* * * * *

UNITED STATES PATENT AND TRADEMARK OFFICE

CERTIFICATE OF CORRECTION

PATENT NO. : 4,491,927

DATED : January 1, 1985

INVENTOR(S) : Einar H. Bachmann, et al.

It is certified that error appears in the above-identified patent and that said Letters Patent are hereby corrected as shown below:

Column 5, line 55 after "henceforth,", delete "we".

Column 6, line 51 after "store", insert --source-- therefor.

Column 9, line 36, delete "Apendix", and substitute --Appendix-- therefor.

Signed and Sealed this

*Sixth* Day of *August 1985*

[SEAL]

*Attest:*

DONALD J. QUIGG

*Attesting Officer* *Acting Commissioner of Patents and Trademarks*